United States Patent [19]

Frank

[11] 4,245,719

[45] Jan. 20, 1981

[54] RAILROAD LUBRICATORS

[75] Inventor: Earl E. Frank, Tallman, N.Y.

[73] Assignee: Abex Corporation, New York, N.Y.

[21] Appl. No.: 972,891

[22] Filed: Dec. 26, 1978

Related U.S. Application Data

[63] Continuation-in-part of Ser. No. 807,538, Jun. 17, 1977, abandoned.

[51] Int. Cl.[3] ..... B61K 3/00

[52] U.S. Cl. ..... 184/3 A

[58] Field of Search ..... 184/3 R, 3 A, 2, 101, 184/102; 239/173, 174

[56] References Cited

U.S. PATENT DOCUMENTS

| | | | |
|---|---|---|---|
| 1,883,148 | 10/1932 | Warr | 184/3 A |
| 1,918,406 | 7/1933 | Krapp | 184/15 R |
| 1,979,307 | 11/1934 | Bates | 184/3 A |
| 2,016,974 | 10/1935 | Stern | 184/3 A |
| 2,059,235 | 11/1936 | Heidenthal | 184/3 A |
| 2,272,775 | 2/1942 | McGarry | 184/3 A |
| 3,163,257 | 12/1964 | McWilliams | 184/3 A |

FOREIGN PATENT DOCUMENTS

| | | | |
|---|---|---|---|
| 126927 | 2/1948 | Australia | 184/3 A |

*Primary Examiner*—David M. Brown

*Attorney, Agent, or Firm*—Kinzer, Plyer, Dorn & McEachran

[57] ABSTRACT

A lubricator (which may be of rail form, tilted on its side) for applying lubricant to a railroad wheel characterized by deep, elongated slots so arranged that lubricant is spread on the wheel in spaced segments during one half the wheel turn and also during the next half turn; the lubricant first applied to the wheel is re-transferred during the second full turn.

5 Claims, 5 Drawing Figures

SEVENTH SLOT 32
EIGHTH SLOT
CW
X-1
X-2
X-3
0°
90°
180°
270°
360°
450°
540°
630°
720°

RAILROAD LUBRICATORS

Reference to Related Application

This application is a continuation-in-part of application Ser. No. 807,538 filed June 17, 1977, now abandoned.

This invention relates to a lubricator for lubricating the part of a railroad wheel known as the back-of-flange.

Lubricators of the foregoing kind may be embodied in a so-called wheel restrainer rail installed on the gauge side of the running rail, usually at a curve in an overhead track system of which the Chicago Loop is an example. The restrainer engages the flange of the wheel at the curve and may be of rail form, tilted on its side, because that is a very inexpensive form.

In known forms, the lubricant (grease) is sometimes applied indiscriminately to the wheel in uncontrolled globs which sometimes drop on the pedestrians below, resulting (understandably enough) in pedestrian complaints embarrassing to elected or appointed officials who nonetheless have safety and nuisance noise in mind. This scene serves to explain one problem faced under the present invention but the invention would be equally applicable to a guarding rail lubricator located on the gauge side of the traffic rail.

The objects of the present invention are to so apply the lubricant that it will be spread out evenly, rather than being present as globs; to assure the area coverage remains substantially the same in spite of wear; and to insure against the possibility of the wheel being damaged due to wear on the lubricator rail.

The invention will be described and claimed in terms of a lubricating rail but it is to be understood an equivalent piece of metal may be used.

IN THE DRAWING

Figures 1, 2, 3, 4, 5:
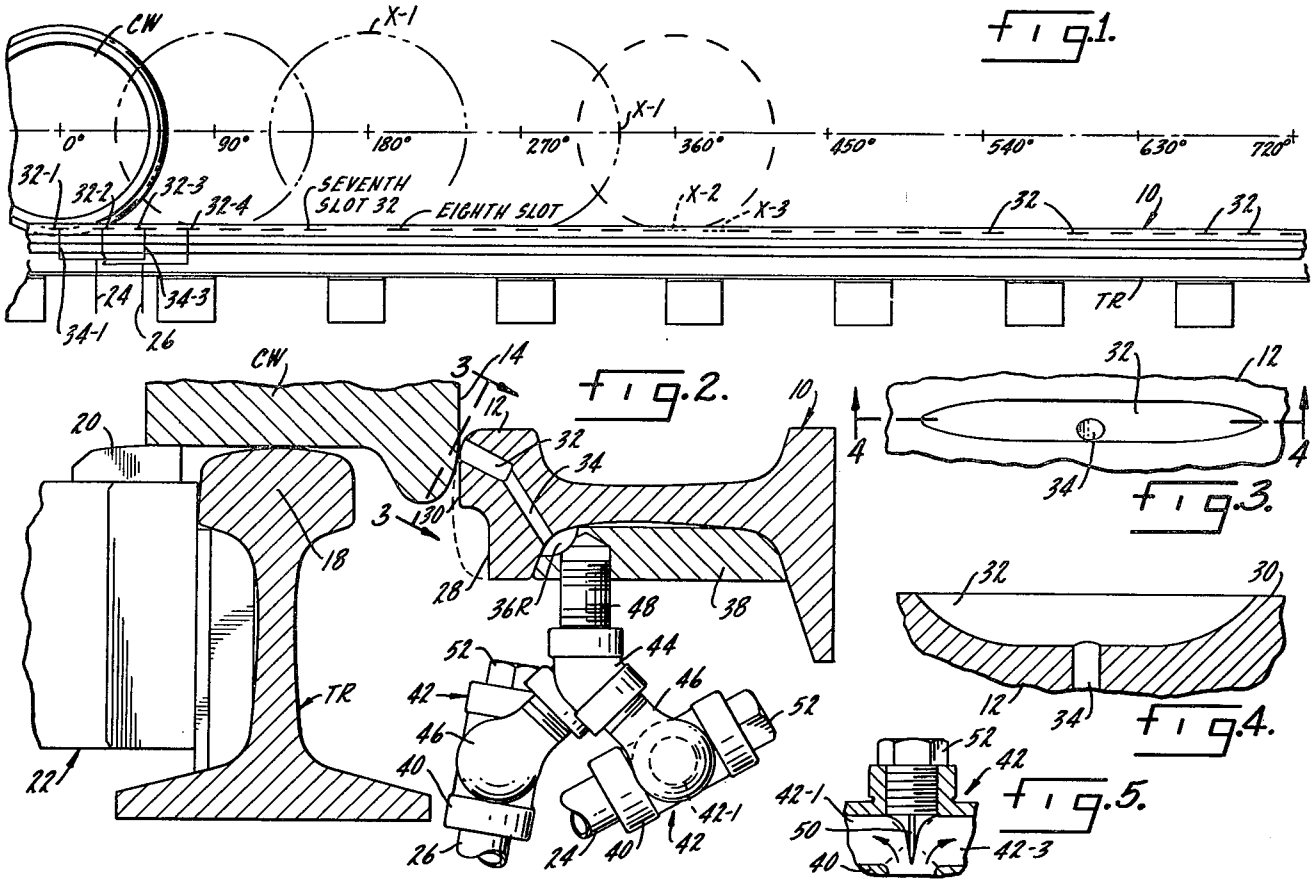
FIG. 1 is a partly diagramatic elevation of a lubricator system constructed in accordance with the present invention.
FIG. 2 is an end elevation of the lubricator.
FIG. 3 is a detail view of one of the slots for distributing lubricant, as viewed along the line 3—3 of FIG. 2.
FIG. 4 is a sectional view of the line 4—4 of FIG. 3.
FIG. 5 is a detail view of a lubricant divider fin.

The lubricator apparatus of the present invention is shown in FIG. 2 as comprising a rail 10 of standard profile tilted on its side so that the head 12 of the lubricator rail 10 is in opposed relation to the back-of-flange 14 of a railroad wheel CW having its tread portion riding on the head 18 of a standard traffic rail TR. The supports for rail 10 are not shown.

The far side of the wheel is shown as engaging a spring-biased plunger 20 supported in a housing 22 on the field side of the traffic rail. The plunger is operated by the wheel CW and is effective in a known manner to allow lubricant (grease) to surge under pressure to hoses 24 and 26 disposed beneath rail 10. Rail 10 is known as a restrainer rail but the principles of the invention would be applicable to a lubricator of the guard rail form in position to lubricate the back-of-tread.

The face of the rail 10 opposed to the wheel is recessed at 28, beneath the effective lubricating face 30, so there will be no possibility of the wheel wearing a groove or ledge in the head 12 of rail 10 likely to create a "track" or rut in which the wheel CW might hang up. Also, the effective face portion 30 of the rail head 12 is machined flat to remove the standard crown evident on the traffic rail TR. By doing this and by slanting the delivery slots or recesses 32 formed by the rail face 30, hereinafter described, wheel wear on surface 30 does not result in any drastic re-orientation of the delivery slot geometry, that is, grease will continue to be applied to substantially the same radius of the wheel.

Lubricant is passed to the wheel through elongated delivery slots formed in the effective face 30 of the rail head 14. The slots 32 are uniformly cigar-shaped (flattened elipsoid) in plan view, FIG. 3, and uniformly saucer-shaped (semi-eliptical) in section or depth as shown in FIG. 4. This is so in order to present substantially the same area for passage of lubricant in spite of continuous wear of the slot over a long period of time.

Each slot 32 receives grease through a related passage 34, FIG. 2, formed in rail 10 communicating with a recess 36R formed in an elongated filler bar 38 fitting the fillet areas beneath the head 12 of rail 10.

To avoid crowding of the hoses, one hose, say 24, services the first and third slots 32-1 and 32-3, FIG. 1, skipping slot 32-2; hose 26 serves slot 32-2 and the fourth slot 32-4. This sequence will be repeated in that a third hose (not shown) will service the fifth and seventh slots, while yet a fourth hose will service the sixth and eighth slots. The eighth slot really starts a new series as will be apparent from the description to follow.

In order that such connections may be accomplished, each hose terminates at one arm 40 of a cross-fitting 42, FIG. 5, constituting a manifold. The two branches 42-1 and 42-3 of the cross-fitting manifold are respectively connected to the related branch passages 34-1 and 34-3 by a pair of interposed elbow-type pipe fittings 44 and 46, connected to one another, and a nipple 48 communicating with the related recess 36R. It may be necessary to insert short pipe lengths between the cross-fitting and the elbow assembly 44-46 and of course the elbow and nipple assembly may vary depending on the space available and the angles involved.

To divide the flow of grease, I provide a divider in the form of a fin 50, FIG. 5, supported on a threaded stud 52. Stud 52 is mounted in an opening in cross-fitting 42, opposite the area where hose 24 is connected to arm 40. The fin 50 thus splits the flow of grease entering the cross-fitting and divides it into equal parts flowing to the two passages as 34-1 and 34-3.

Slots 32 are so positioned that after 180° of wheel turn, FIG. 1, the first spot of grease X-1, FIG. 1, is at the top of the wheel; similar spots are in trailing position on the wheel. Then, after a 360° turn the spot of grease X-1 is deposited at X-2 on the working face 30 of rail 10 which is a "dry" area. The spot of grease on X-1 could also be deposited at X-3 which is also a dry area, or at any location between X-2 and X-3 depending on the preference, meaning a slight change in the distribution and size of the slots, which is always possible. This depends too on wheel diameter. In the illustration given in FIG. 1 which assumes a 28" wheel diameter, the slots are five inches long on six inch centers but the slots could also be on seven inch centers.

As shown in FIG. 1 there are seven slots 32 to begin with, then a repeating series of seven slots and then a third series, covering the distance of eleven feet from the center of the first slot to the center of the last but it will also be noted that rail length is indefinite; it may be as long as thirty-nine feet, which is standard.

Assuming it is dry area X-2 to which grease is first re-transferred after a 360° turn of the wheel, similar dry areas between the third set of downstream slots (360°-720°) will be covered while at the same time the dry areas on the wheel not lubricated during the first complete turn will receive grease from the downstream slots during the 360°-720° transit.

Theoretically, rail 10 at the start has dry areas not covered until after there have been two full turns of the wheel; as a practical matter rail 10 will be "primed" at the time of installation and besides, particularly at turns, there is some swing or "play" in the car trucks which also results in more spreading of the grease. All rail systems have cars with standard diameter wheels, larger or smaller. In any practical installation, the lubricator slots as 32-1, 32-4 will be spaced accordingly, preselected that is.

In any event, under the present invention, the wheel itself cooperates in returning grease to the dry areas on the lubricator face 30, between the slots 32; the slots are so designed that wear will not alter materially the geometric features; the manifolds and branch passages are so related to the hoses that the hoses will not be crowded; and the grease is evenly divided at the branches of the manifold.

The elongated lubricator slots play an important role under the present invention, requiring an explanation of what causes a wheel to screech or squeal as the car rounds a turn equipped with a guarding rail. The noise is related to the phenomenon known as stick, slip friction. What happens is the flange of the wheel is thrust against the guarding rail because of centrifugal force. The large mass and momentum causes a spot on the wheel to "weld" instantaneously to the rail, the momentum of forward movement next breaks the weld, then a new spot welds as the wheel turns, and so on. The repeated welding and breaking cause the plate of the wheel to vibrate and that originates the screech. The magnitude of the screech depends upon the speed of the car and the radius of the turn.

In an instance where there is an attempt to lubricate the wheel or rail by a mere dab of grease applied through a small round orifice, one orifice spaced a considerable distance from another as in McGarry U.S. Pat. No. 2,272,775, the lubricating effect is desultory because the slug of lubricant is simply sheared off by the passing wheel and is not spread out. Indeed, that accounts for grease dropping on the pedestrian walking beneath an overhead rail system. But more importantly, the wheel is incompletely covered with lubricant and the wheel may continue to screech. Under the present invention, the elongated slot, plus its depth, prevents shearing of the grease which does not emerge as a mere glob or dab easily sheared, but is presented to the wheel like a sausage length of grease, not easily sheared off but rather spreading flat on the wheel.

I claim:

1. Railroad lubricator apparatus for applying lubricant to a railroad wheel, applied from one face of an auxiliary rail, said rail having a first series of longitudinally spaced lubricant delivery slots formed in said face thereof to apply lubricant as a corresponding series of spaced segments as the wheel moves past said rail, said rail having a second series of longitudinally spaced lubricant delivery slots formed in said face thereof and so spaced downstream of the first that as the lubricated wheel rotates therepast the wheel transfers lubricant to the spaces between the second-series slots while the wheel itself receives lubricant from the second series of slots, said rail having a series of branch passages for delivering lubricant to alternate ones of the delivery slots, a manifold for supplying grease to the branch passages, and each manifold having a divider fin to divide the supply of lubricant into substantially equal parts for delivery to the branch passages.

2. Apparatus according to claim 1 wherein said rail has a standard rail head in which said slots are formed in a restricted portion, the remaining portion of said rail head being removed to prevent the wheel from forming a rut therein.

3. Apparatus according to claim 1 wherein the shape of each slot is cigar shaped in plan and saucer shaped in depth such that the area of the slot remains substantially invariant in spite of wear.

4. Apparatus according to claim 3 wherein said rail has a standard rail head in which said slots are formed in a restricted portion, the remaining portion of said rail head being removed to prevent the wheel from forming a rut therein.

5. In a railroad system where the traffic rails are traversed by a car equipped with wheels of a given diameter, lubricator apparatus positioned at one side of a traffic rail for applying lubricant to the flange of a railroad wheel, applied from one face of an auxiliary rail facing the traffic rail, said auxiliary rail having a series of elongated longitudinally spaced lubricant delivery slots formed in said face thereof to spread lubricant on the wheel as a corresponding series of spaced segments completely around the wheel as it turns 360° past said auxiliary rail, said slots being so spaced from one another and of such number and dimension related to the wheel diameter that: the wheel traverses many slots for each of two successive 180° turns of the wheel and thereafter simultaneously transfers lubricant to spaces between the slots while itself receiving lubricant from slots while subsequently turning through 360°-540°.

* * * * *